United States Patent [19]

Harper

[11] 3,946,525

[45] Mar. 30, 1976

[54] AUTOMATIC BUFFING MACHINE

[76] Inventor: John Ford Harper, Ames Hollow Road, Portland, Conn. 06480

[22] Filed: Nov. 18, 1974

[21] Appl. No.: 524,741

[52] U.S. Cl. ..... 51/76 R; 51/105 R; 51/216 T

[51] Int. Cl.[2] ..... B24B 5/06

[58] Field of Search..... 51/76 R, 80 A, 88, 103 R, 51/105 R, 108, 110, 138, 236, 216 T; 15/59, 60; 188/290, 296

[56] References Cited

UNITED STATES PATENTS

| | | | |
|---|---|---|---|
| 2,177,898 | 10/1939 | Leguillon | 51/108 R X |
| 2,386,649 | 10/1945 | Belcourt | 51/108 R |
| 2,626,487 | 1/1953 | Janusauskas | 51/76 R |
| 2,964,883 | 12/1960 | Harper | 51/76 R |
| 3,295,261 | 1/1967 | Murray | 51/76 R X |
| 3,365,842 | 1/1968 | Lohmeier | 51/236 X |

*Primary Examiner*—Donald G. Kelly
*Assistant Examiner*—Nicholas P. Godici
*Attorney, Agent, or Firm*—John B. Willard

[57] ABSTRACT

The buffing machine of the present invention includes one or more buffing wheels to which workpieces are successively presented on a continuously traveling conveyor wherein the workpieces are rotatably mounted. The axis of workpiece rotation is adjustable to any angle desired relative to the conveyor travel and the axis of a buffing wheel. The angle the axis of rotation of the workpiece makes with the buff wheel axis is selected so that rotation of the buffing wheel imparts a desired speed of rotation of the workpiece.

5 Claims, 6 Drawing Figures

AUTOMATIC BUFFING MACHINE

Figure 1:
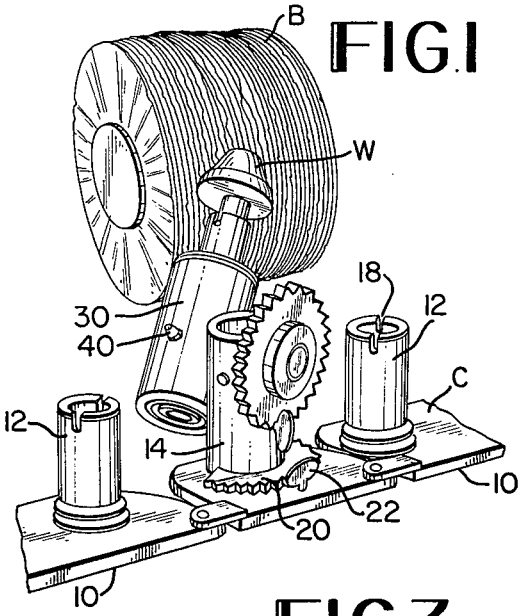
Figure 2:
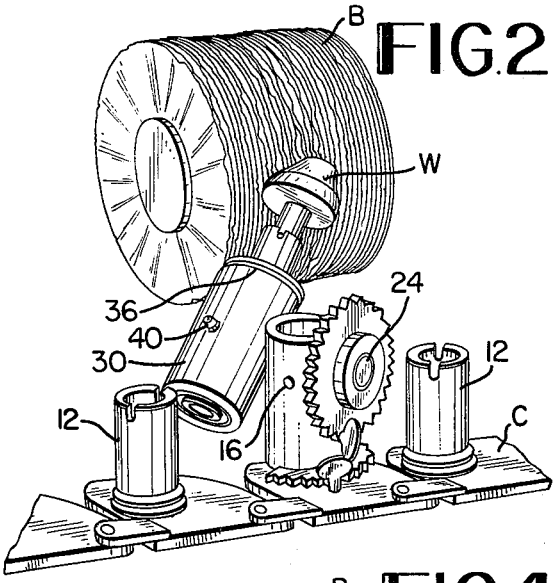
Figure 3:
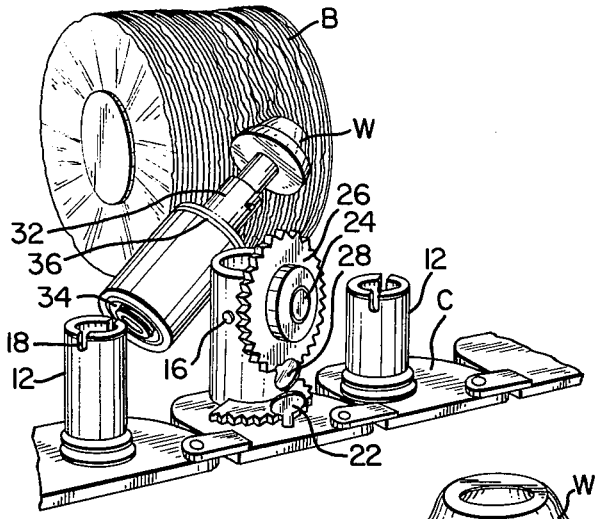
Figure 4:
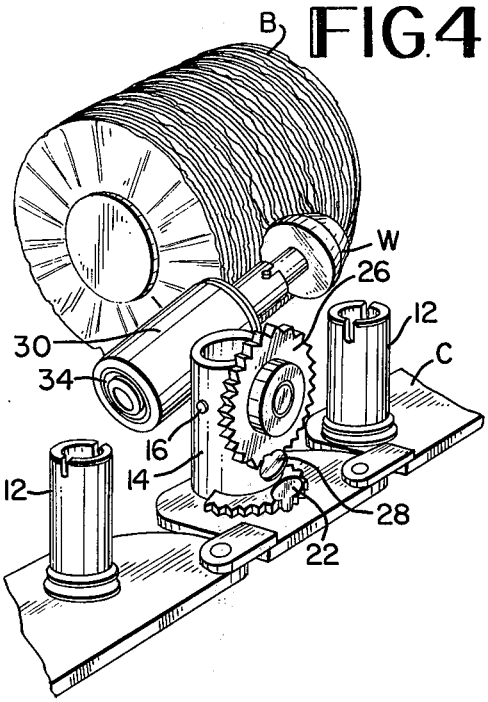

This invention generally relates to buffing machines and has as a primary object the provision of improved automatic buffing equipment for effecting registry and adjustment of successive workpieces in proper buffing relation to buffing wheels to provide high quality product finishes in a high production operation wherein the workpieces are being continuously advanced to successive buffing wheels.

Another object of the invention is to provide an improved high production buffing machine capable of finishing workpieces of varying shapes and sizes in a continuous machine operation wherein rotation of the workpieces is regulably effected by engagement with the rotating buffing wheel.

A further object of the invention is to provide a machine of the above described type for effecting a buffing operation wherein freely rotatable workpieces are rotated by a rotating buffing wheel and at a selected rate of rotation less than that of the buffing wheel.

Another object of the invention is to provide an improved buffing machine in which successive workpieces supported on a continuously traveling conveyor are automatically registered in sequence with successive buffs and wherein the buffs rotate the workpieces during buffing engagement therebetween.

A further object of the invention is to provide a machine of the type heretofore described in which the axes of the buffs and the position of the associated workpieces are maintained in preselectable relationship during buffing engagement and wherein the speed of rotation of the workpieces is effected by the buffing wheels and can be preselected and maintained during engagement of each buff and its associated workpiece.

A still further object is to provide a machine as heretofore described in which the travel of the workpieces is along a common straight path, while angularly disposed relative to the buff shafts, the angle being selected to provide greater workpiece rotation and less buffing action as lesser angles are selected and less rotation and more cut as the angle is increased.

Another object is to provide a machine of the type indicated wherein the frictional engagement of a workpiece to a conforming adapter restricting rotation therebetween is greater than the friction restraining rotation of the adapter relative to a conveyor on which the adapter is rotatably mounted.

Still further object is to assure that in contact with the buff the surface speed of a workpiece is less than the engaged surface of the buff and wherein the workpiece speed is derived from the buff.

Still another object of the invention is to provide an improved buffing machine which is readily installed to provide reliable operation over a long service life with minimal maintenance and equipment requirements.

Other objects will be in part obvious and in part pointed out more in detail hereinafter.

The invention accordingly consists in the features of construction, combination of elements and arrangement of parts which will be exemplified in the construction hereafter set forth and the scope of the application which will be indicated in the appended claims.

Figure 5:
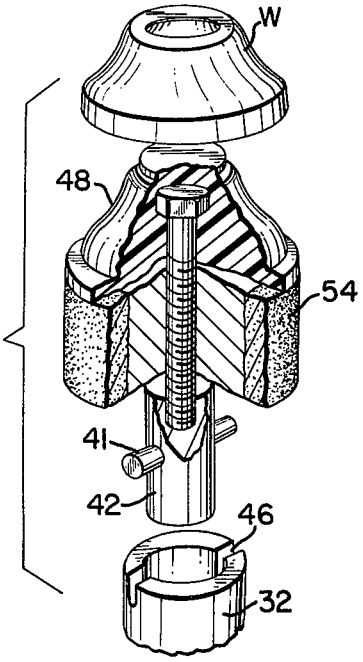
Figure 6:
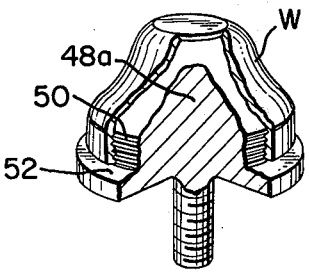

In the drawings:

FIGS. 1 – 4, inclusive, are perspective views of buffing wheel, conveyor and workpiece holder in selected positions of adjustment relative to each other in accordance with the present invention;

FIG. 5 is an enlarged perspective view of the workpiece and the adapter portion of the holder shown in FIGS. 1 – 4; and FIG. 6 is a perspective view of an adapter for an alternate workpiece internally threaded.

Referring to the drawings as shown in FIGS. 1 – 4, a conveyor C consisting of a series of articulately connected carriages 10 successively presents successive workpieces W to a buff wheel B.

The conveyor C is merely illustrative and is shown only fragmentarily as the details of its construction and drive for advancing its successive carriages 10 in a straight path through successive buffing stations of one or more buffing wheels B are well known and may involve numerous variations.

Singularly, the buff wheel B is shown without details of drive or mounting buffing heads and supports for selectively positioning the buff wheel axis relative to the conveyor and line of travel of successive workpieces is well known as is the means for adjusting the wheel axis to compensate for buff wear. Illustrative conveyor and buff wheel assemblies are shown, for example, in U.S. Pat. No. 2,964,883 issued Dec. 20, 1960, to J. F. Harper, the present inventor.

Journalled in each of the conveyor carriages 10 may be one or more work spindles 12 which may carry and rotate work holders by means of work spindle drives which are complicated and expensive.

In accordance with the present invention, rotation of the workpieces W is effected solely by the buff wheel B and the speed of rotation selected by adjustment of the axis of the workpiece relative to the axis of the buff wheel B and line of travel of the conveyor C.

The conveyor work spindles 12 act merely as mounting supports for the work holder assemblies generally designated H.

As shown in FIGS. 1 – 4, each holder H includes a sleeve 14 which slides on the spindle 12 and includes a pin 16 which registers in spindle slot 18 to prevent rotation of sleeve 14 on spindle 12. Welded or otherwise secured to the sleeve 14 is a gear segment 20, the position of which may be adjustably secured on the carriage 10 by a thumb screw 22.

Horizontally journalled in the vertically mounted sleeve 14 is a shaft 24 which extends through the sleeve 14. Secured on one end of the shaft 24 is a gear 26 which may be locked in a selected position of adjustment by a thumb screw 28.

Secured to the opposite end of the shaft 24 which extends through the sleeve 14 is a housing 30 in which an adapter spindle 32 is rotatably journalled in suitable bearings 34 and 36 secured in the ends of the cylindrical housing 30.

Preferably, acceleration of the shaft 32 to a selected speed may be impeded by a viscous bath introduced into the housing 30 as through a grease fitting 40 and may be accentuated as by vanes (not shown) or other impediments secured to the shaft 32 in the viscous bath within the housing 30.

The shaft 32 preferably is tubular or otherwise adapted to readily receive and hold identical stud portions 42 of adapters generally designated A. As shown in FIG. 5, a pin 44 engages in slot 46 to hold the adapter stud 42 against turning in shaft 32.

Secured on the upper or outer end of the adapter stud 42 is an adapter body 48 conforming to and adapted to receive the interior of the workpiece W. Preferably the body 48 of the adapter may be plastic of similar material having a relatively high coefficient of friction to prevent rotation of the workpiece W relative to the adapter particularly if the workpiece W does not have an interior configuration that inherently keys to the adapter.

However, it has been found that a hard material such as steel is preferable for the adapter body 48a when the workpiece is internally threaded as to 50 (FIG. 6). The adapter 48a may include a shoulder 52 which engages the lip of the workpiece W and limits the distance the adapter can penetrate the workpiece and the amount that the workpiece may be inadvertently threaded on the adapter.

As shown in FIG. 5, the component of buff contact that acts to rotate rather than buff the workpiece W and its adapter in the bearings 34 and 36 may be augmented by cylindrical skirt portion 54 beneath the plastic body 48 to which the interior of the workpiece adheres. Preferably the adapter skirt 54 is a ceramic of grinding wheel character which resists abrasion of the buff wheel B while transferring the drive of the buff B to the adapter A.

In practice the positions of buff B, conveyor C, the adapter shaft 32 are selected so that rotation of the adapter A is deliberate. Excessive rotation of the adapter A results as the shaft 32 more nearly parallels the axis of the buff B.

Conversely, when the shaft 32 is positioned more nearly at right angles to the buff axis the less the turning effect of the buff on the workpiece.

A fluid or other drag on the adapter spindle 32 prevents excessive rotation particularly in early contact as the workpiece accelerates to equilibrium. Initial rotation is slower and cutting action of the buff more aggressive. Final action of the buff B is less aggressive with a greater blending and coloring action.

A buffing machine of the above described structure provides for proper contact between each workpiece and a buff wheel which is automatically established in a high speed production operation providing high quality polishing and finishing while substantially eliminating intricate and expensive fixtures and adapter drives. In addition, the described structural arrangement significantly facilitates loading and unloading of the workpieces in a position removed from the buffing zone whereby an operator is provided freedom of movement to work efficiently in complete safety.

As will be apparent to persons skilled in the art, various modifications and adaptations of the structure above described will become readily apparent without departure from the spirit and scope of the invention, the scope of which is defined in the appended claims.

I claim:

1. In combination, a rotated buff wheel, a conveyor having a straight line of travel disposed at a selected angle and distance relative to the axis of rotation of the buff wheel, and a workpiece carried by an adapter that is rotatably mounted on the conveyor, said adapter including means that are rotated by said buff wheel to impart rotation to said workpiece while said workpiece is simultaneously being buff by surface engagement with said rotated buff wheel wherein the workpiece and adapter is both rotated and buffed by surface engagement of the rotated buff wheel.

2. The combination of claim 1 wherein the buff wheel engages both the workpiece and adapter.

3. The combination of claim 1 including means for adjustably selecting the angle and distance of the axis of the buff wheel relative to the axis of rotation of the adapter and workpiece.

4. The combination of claim 3 wherein the buff wheel surface speed is greater than the surface speed imparted to the workpiece and adapter by the buff.

5. The combination of claim 4 wherein the friction between the workpiece and adapter prevents rotation therebetween while rotating the workpiece and adapter relative to the conveyor at a lesser speed than the buff wheel.

* * * * *